US005508788A

United States Patent [19]

Watanabe et al.

[11] Patent Number: 5,508,788

[45] Date of Patent: Apr. 16, 1996

[54] IMAGE FORMING APPARATUS HAVING CONTACT CHARGER WTIH SUPERPOSED AC/DC BIAS

[75] Inventors: Takeshi Watanabe, Ichikawa; Minoru Yoshida, Tokyo, both of Japan

[73] Assignee: Kabushiki Kaisha Toshiba, Kawasaki, Japan

[21] Appl. No.: 291,701

[22] Filed: Aug. 16, 1994

[30] Foreign Application Priority Data

Sep. 22, 1993 [JP] Japan ..... 5-259229
Sep. 22, 1993 [JP] Japan ..... 5-259355

[51] Int. Cl.[6] ..... G03G 21/00

[52] U.S. Cl. ..... 355/208; 355/219

[58] Field of Search ..... 355/208, 219, 355/274, 276; 361/225

[56] References Cited

U.S. PATENT DOCUMENTS

| | | | |
|---|---|---|---|
| 4,672,505 | 6/1987 | Tsuchiya et al. | 361/225 X |
| 5,144,368 | 9/1992 | Ohzeki et al. | 355/219 |
| 5,229,818 | 7/1993 | Nakahara et al. | 355/219 X |
| 5,305,177 | 4/1994 | Aoki et al. | 355/219 X |
| 5,365,316 | 11/1994 | Motoyama et al. | 355/219 |
| 5,420,671 | 5/1995 | Kisu et al. | 355/219 |

FOREIGN PATENT DOCUMENTS

| | | |
|---|---|---|
| 0012276 | 1/1990 | Japan . |
| 0069781 | 3/1990 | Japan . |
| 0181962 | 6/1992 | Japan . |
| 0181350 | 7/1993 | Japan . |

*Primary Examiner*—Robert Beatty
*Attorney, Agent, or Firm*—Foley & Lardner

[57] ABSTRACT

An image forming apparatus including a contact charger for charging the surface of an image carrying body, a latent image forming unit for forming an electrostatic latent image on the charged image carrying body, a developing device for developing the latent image to form a visible image, a power source for applying a DC/AC superposed bias to the contact charger, a detector for detecting the current value of the superposed bias applied to the contact charger, and a device for controlling the AC:DC voltage ratio of the superposed bias applied to the contact charger, in accordance with a detected value from the detector. The AC bias is between 150 to 400 V while the DC bias is set between 500 to 800V.

11 Claims, 8 Drawing Sheets

IMAGE FORMING APPARATUS HAVING CONTACT CHARGER WTIH SUPERPOSED AC/DC BIAS

BACKGROUND OF THE INVENTION

1. Field of the Invention

The present invention relates to an image forming apparatus, and more particularly, to an image forming apparatus furnished with an improved contact charger capable of producing higher-quality images.

2. Description of the Related Art

Conventionally, a corona discharge unit having a scorotron charger has been the leading electrophotographic charger.

Since corona charging utilizes the effect of electrical discharge, however, a large quantity of harmful ozone is produced in negative charging, in particular. Moreover, the applied voltage is relatively high, ranging from −4 to −5 kv, so that most of current flows through the casing of the unit, and a great energy loss is caused.

Recently, therefore, contact charging which hardly produces ozone has been developed as a technique to replace the corona charging. Typical contact charging systems include a roller charging system using an electrically-conductive roller and a brush charging system using an electrically-conductive brush. In either case, the quantity of ozone produced is believed to be one hundredth of the value for a corona charger, and the applied voltage is as low as about −1 kV. Thus, no current flows through the casing, so that the energy loss is small.

However, the roller charging system is susceptible to toner and dust, such as paper dust, which may directly cause unevenness of charging, thus affecting the resulting image. Moreover, this system has a complicated construction, requires high mechanical accuracy, and therefore, is expensive.

On the other hand, the brush charger is more resistant to soiling by toner and paper dust than the roller charger, and is low-priced. Accordingly, it is an effective charging means for use in a compact, inexpensive apparatus. Owing to its configuration, however, the brush charger is subject to a drawback that a number of white stripes are formed along the direction of movement of an object of charging when halftone printing is carried out in an electrophotographic process using a copying machine or printer, especially of the reverse developing system. In the negative-charging reverse developing system, the white stripes indicate a local elevation of the surface potential of the object of charging on the negative side. This phenomenon, which is attributable to unevenness of charging peculiar to the brush charger, occurs for a long period of time from the initial stage of use of the apparatus when a DC bias is applied in hot and humid ambient conditions. This phenomenon is marked when a brand-new brush is used, in particular.

Further, the production of white stripes peculiar to the brush charger can be reduced by superposing such a specific AC bias on the DC bias as uniform convergent charging of the object of charging is not caused (Japan Patent Application No. 5-66302). In this method, those portions with unduly increased potential are de-electrified in a reverse charging process using an AC bias. Thus, the halftone image quality, as well as the image quality in the initial state of the brush, can be made much better than in the case where only the DC bias is applied.

According to this method, however, the resistance of the charger to dirt is worsened. More specifically, toner and paper dust from a cleaning unit adhere to the charger, so that charge failure is caused and appears in the form of black stripes on the paper after preparation of thousands of prints.

In contact charging using a charging brush or the like, furthermore, the charging performance is often worsened by change of charging members with time. The surface potential changes by nearly 150 V in a predetermined period of time after the start of printing, so that the image density inevitably varies by a large margin during this period.

SUMMARY OF THE INVENTION

The object of the present invention is to provide an image forming apparatus in which the surface potential of an image carrying body is stabilized for higher image quality for a long period of time from an initial stage.

According to the present invention, there is provided an image forming apparatus which comprises: contact charging means for charging the surface of an image carrying body; image forming means for forming an electrostatic latent image on the charged image carrying body; means for applying a DC/AC superposed bias to the contact charging means; detecting means for detecting the current value of the superposed bias applied to the contact charging means; and means for controlling voltage ratios for DC and AC components of the superposed bias applied to the contact charging means, in accordance with a detected value from the detecting means.

According to the present invention, moreover, there is provided an image forming apparatus which comprises: contact charging means for charging the surface of an image carrying body; image forming means for forming an electrostatic latent image on the charged image carrying body; means for applying a DC/AC superposed bias to the contact charging means; and means for controlling voltage ratios for DC and AC components of the superposed bias applied to the contact charging means, in accordance with the surface potential of the image carrying body.

According to the present invention, furthermore, there is provided an image forming apparatus which comprises: contact charging means for charging the surface of an image carrying body; latent image forming means for forming an electrostatic latent image on the charged image carrying body; developing means for developing the latent image to form a toner image; transfer means for transferring the toner image to a transfer medium in contact with the image carrying body by coming into sliding contact with the transfer medium; aging means for performing aging operation such that the surface of the image carrying body is charged by means of the contact charging means without actuating the transfer means when no image is formed; charging current detecting means for detecting charging current with which the contact charging means charges the surface of the image carrying body; and means for changing the operation mode from the aging operation to operation for image formation on the transfer medium in response to the current value detected by the charging current detecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 6 is a flow chart showing the sequence of initializing operation with the machine power on;

DETAILED DESCRIPTION OF THE PREFERRED EMBODIMENTS

Figure 1:
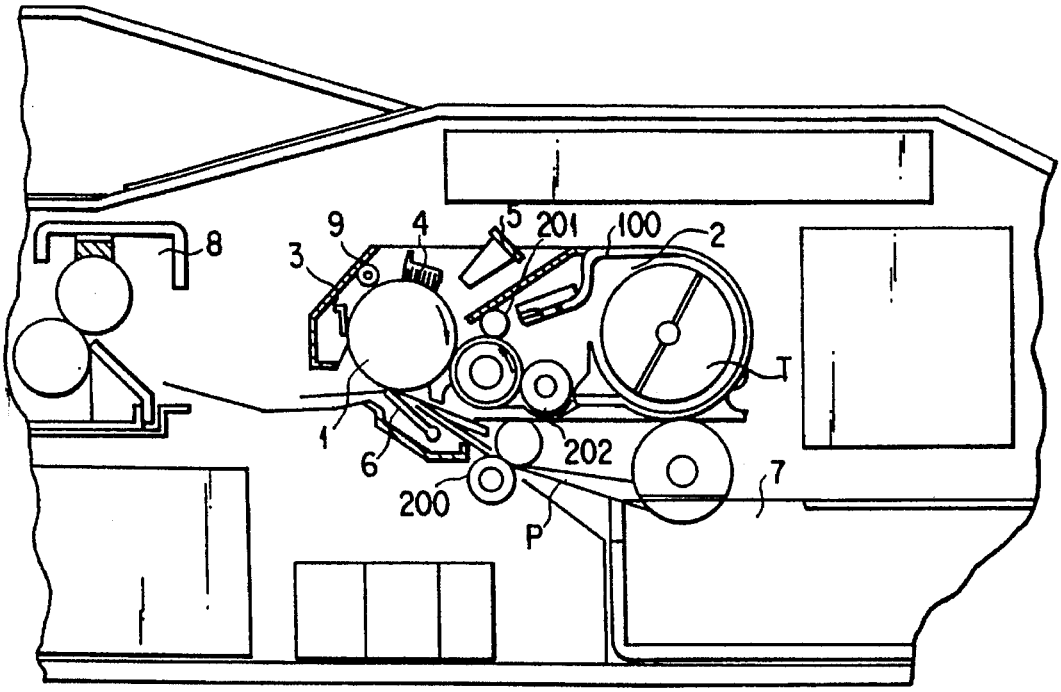
FIG. 1 is a sectional view of an image forming apparatus according to an embodiment of the present invention.

In an image forming apparatus according to a first embodiment of the present invention, contact charging means is used as charging means, and the value of charging current supplied to the contact charging means is detected in consideration of the characteristic of the charging current to vary depending on the surface potential of an image carrying body. The surface potential of the contact charging means is stabilized by providing means for controlling the voltage ratios for DC and AC components applied to the charging means on the basis of the detected value. The AC component used has a value not higher than the convergent charge region.

Preferably, the voltage ratios for the DC and AC components of a superposed bias range from DC 500 to 800 V and from AC 150 to 400 V, respectively, further preferably, from DC 500 to 650 V and from AC 300 to 400 V. The AC frequency preferably ranges from 200 Hz to 2 kHz, further preferably from 200 Hz to 1 kHz.

The control of the voltage ratios for the DC and AC components of the superposed bias can be achieved by, for example, changing the voltage ratios in stages or continuously. In a typical mechanism for controlling the voltage ratios for the DC and AC components, a current detector may be provided between a DC/AC superposed bias source and a charger so that the voltage ratios can be changed in response to detection signals from the detector. Since no charge failure occurs in an initial state, for example, there is a relatively large flow of current. If the current flow is stabilized afterward and when the number of prints exceeds a predetermined value so that charge failure develops gradually, the current value lowers considerably. Thereupon, the lowering current value is detected, and the ratio for the AC component of the DC/AC superposed bias is lowered to prevent the charge failure when the current value is reduced below a preset point for the machine.

A satisfactory effect can be also obtained by only changing the the voltage ratios for the DC and AC components in accordance with the consumption of paper sheets after a process cartridge is set in place, without providing the current detector.

Thus, according to the image forming apparatus of the first embodiment of the invention, the surface potential of a photoreceptor can be stabilized so that good image quality can be maintained for a long period after a user's first use of a brand-new charger.

An image forming apparatus according to a second embodiment of the present invention is provided with aging means for aging operation such that the surface of the image carrying body is charged by means of the contact charging means without actuating transfer means for a predetermined period of time during which no image is formed. Thus, when using new contact charging means, in particular, the initial-state charging potential can be stabilized, and the image quality can be improved by performing the aging operation by means of the aging means during the non-imaging period.

This apparatus comprises, besides the aging means, charging current detecting means for detecting charging current, with which the contact charging means charges the surface of the image carrying body, and means for changing the operation mode from the aging operation to operation for image formation on the transfer medium when the current value detected by the detecting means is within a predetermined range. According to this arrangement, the characteristic of the charging current to vary depending on the surface potential of the image carrying body is utilized, the surface potential is stabilized by the aging operation, and the aging operation is finished when a predetermined value is reached by the surface potential. Thus, the aging operation can be prevented from being performed for an excessively long period of time.

FIG. 1 is a sectional view showing an image forming apparatus which is furnished with a contact charger according to the present invention. This apparatus is a laser printer with a printing speed of 8 prints/min.

In FIG. 1, numeral 100 denotes a process unit, which includes a photoreceptor drum 1, a developing device, a cleaner 3, and a charging brush 4. The drum 1 has a diameter of 24 mm, and the developing device 2 is a one-component developing device of the nonmagnetic-contact type.

The charging brush 4 is supplied with a bias from a DC constant-voltage source (or DC/AC superposed voltage source). The entire surface of the photoreceptor drum 1 is uniformly negatively charged by means of the brush 4. Thereafter, an electrostatic latent image is formed on the negatively charged drum surface by means of exposure means 5, and a toner image is formed on the drum 1 by causing a toner to adhere to the latent image by means of the developing device 2 (reverse developing).

A paper sheet P fed from a paper cassette 7 is intimately in contact with the photoreceptor drum 1 within a contact nip region between a transfer brush 6 and the drum 1. In this nip region, the toner image is transferred to the sheet P by means of a bias applied to the brush 6. The paper sheet P, having the unfixed image on its surface, is heated and pressurized by means of a fixing device 8, whereupon the image is fixed to the sheet P. The residual toner remaining on the photoreceptor drum 1 is removed from the drum by means of the cleaner 3.

The following is a description of the one-component developing device of the nonmagnetic-contact type. A developing roller 200 is a roller of 12-mm diameter which is formed by covering a metal shaft of 6-mm diameter with a rubber layer having a predetermined resistance value. The hardness of the material of the rubber layer is adjusted to 28 to 50 degrees (JIS-A, to be repeated in the following), whereby a reliable developing nip free from permanent distortion can be obtained. Also, a clear image can be obtained without a bias leak by adjusting the resistance value of the rubber material to $10^4$ to $10^{10}$ Ω·cm. An urethane coating with good toner releasability is applied to a thickness of 10 to 150 μm on the surface of the roller 200, thereby preventing cohesion of the toner without spoiling the elasticity of the roller. After the application of the surface layer, the hardness of the roller rubber ranges from 30 to 55 degrees. In order to maintain the developing characteristics, the resistance of the surface layer should be adjusted to about $10^5$ to $10^{10}$ Ω·cm. Further, a charge control agent is dispersed in the surface layer in consideration of the friction charging performance for the toner.

A layer forming member 201 is in contact with the developing roller 200 under a contact pressure of 300 to 1,500 g, and charges the toner while regulating the thickness of a toner layer formed on the developing roller. In the member 201, the same layer as the surface layer of the developing roller is formed on a metal rod of 10-mm diameter, whereby charging performance and toner releasability are secured. Although the layer forming member 201 is fixed in the example shown in FIG. 1, it may alternatively be made rotatable with a difference in peripheral speed from the developing roller. In the example shown in FIG. 1, moreover, the member 201 has the same potential as the developing roller 200. Alternatively, however, a potential difference may be provided such that the amount of toner on the developing roller can be controlled or toner charging can be effected by charge injection.

A toner supply roller 202, which is composed of a foam roller (shaft diameter: 6 mm, roller diameter: 12 mm) with a volume resistance of $10^5$ to $10^{11}$ Ω·cm and hardness (ASKER-C) of 20 to 35 degrees, supplies the toner to the surface of the developing roller 200. In the example shown in FIG. 1, the supply roller 202 is in contact with the developing roller 200 with a bite depth of 0.7 mm, and carries out separation of the toner from the developing roller and charging as well as the toner supply.

In the example shown in FIG. 1, the toner used has negative charging polarity, and contains polyester resin as a binder. The particle diameter of the toner is 10.2 μm (volume average particle diameter).

When this toner was used in the developing device constructed in this manner, the toner layer formed on the developing roller 200 exhibited a charge amount of −8.2 μc/g and build-up amount of 0.73 mg/cm$^2$.

The transfer brush 6 is arranged so that a brush with a volume resistance of $10^5$ to $10^{12}$ Ω·cm, and density of 10,000 to 400,000 fibers/inch is held between metal sheets. A bias applied to the brush 6 is opposite in charging polarity to the toner, and ranges from +500 to +2,000 V. To avoid soiling, the brush 6 is arranged so as to be separable from the photoreceptor drum 1.

An experiment was conducted using the dry electrophotographic laser printer of the reverse developing type described above. Although the photoreceptor drum is negatively charged, only absolute values without the minus sign will be used in the description to follow for ease of illustration. It is to be understood that the present invention may be applied to the regular developing system without any modifications except for the positivity of numerical values.

Figure 2A:
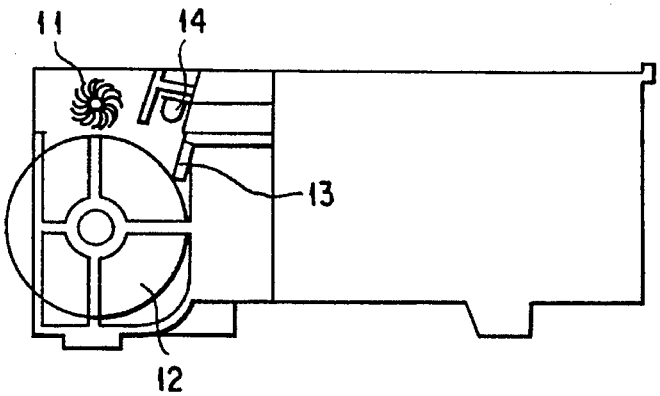
FIG. 2A is a view showing a process cartridge with a rotating-brush charger.
Figure 2B:
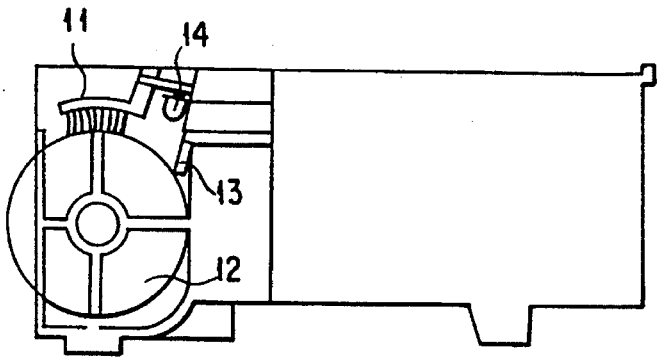
FIG. 2B is a view showing a process cartridge with a stationary-brush charger.

FIGS. 2A and 2B show examples of process cartridges furnished with a brush charger. Each brush charger used is formed of rayon fibers (fiber diameter: 10 to 50 μm, density: 10,000 to 200,000 fibers/cm$^2$) with carbon dispersed therein. The brush charger shown in FIG. 2A is of a rotating type (outside diameter: 15 ϕ, overall brush resistance: $10^5$ to $10^7$ Ω, bite: 0 to about 1 mm, rotating direction: against photoreceptor drum rotation, peripheral speed ratio: 1:1 or higher) with a drive system, and the one shown in FIG. 2B is of a stationary type (material: same as rotating type, bite: 0 to about 1 mm, brush width: 3 to 9 mm) attached to a fixed supporting member.

Figure 14:
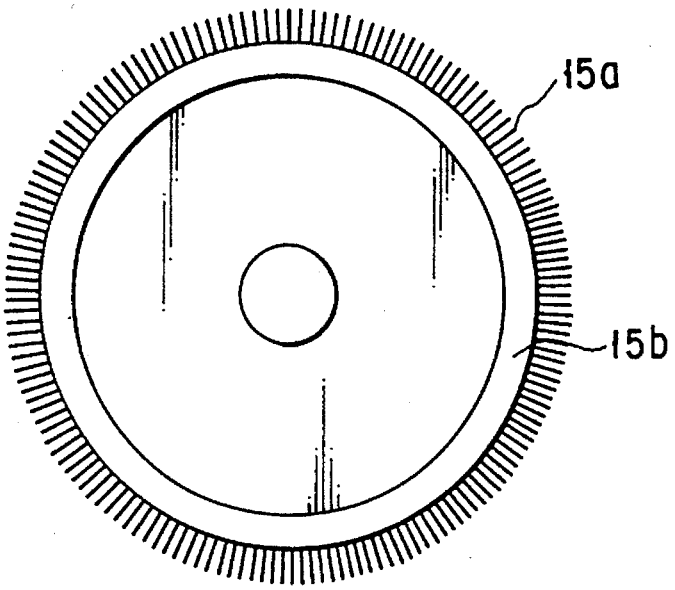
FIG. 14 is a view showing a rotating-brush charger.

More concretely, as shown in FIG. 14, the rotating brush charger may comprise a conductive roller **15*b* and rayon fibers 15*a* planted on the roller 15*b* at density of 10,000/inch. The rayon fibers have a resistivity of $10^8$ Ω·cm. As usual, the fibers have been processed such that they extend slantwise with respect to the circumferential surface of the roller 15*b***.

Figure 15:
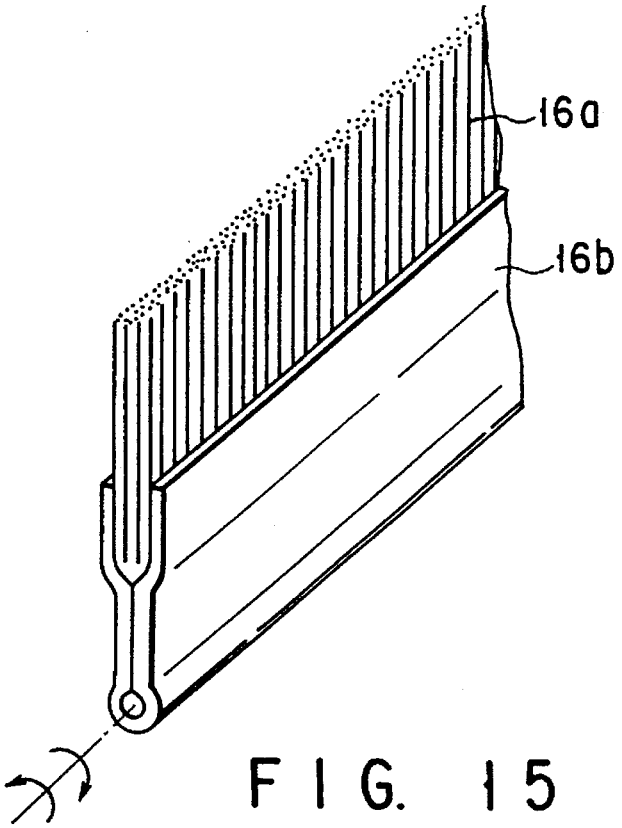
FIG. 15 is a view showing a stationary-brush charger.

As shown in FIG. 15, the stationary brush charger may comprises a folded aluminum plate **16*b* having a thickness of 1 to 3 mm and rayon fibers 16*a* clamped between both ends of the folded aluminum plate 16*b* at density of 10,000 to 400,000/inch. The rayon fibers 16*a*** have a resistivity of $10^3$ to $10^{11}$ Ω·cm.

In general, a process unit has a preset life performance of thousands to tens of thousands of prints, and is entirely replaced with a new one by the user when the life of the process unit incorporated in a copying machine or printer terminates. Many of process units comprise a brush charger 11, photoreceptor drum 12, cleaning blade 13, de-electrifier (lamp) 14, etc. each. In most cases, the brush charger 11 is previously mounted in the process unit so as to be in contact with the photoreceptor drum 12 before delivery at the factory. The charger 11 starts to be used for printing immediately after the process unit is replaced by the user.

If the brush charger 11 is a brand-new one, however, the surface potential of the photoreceptor drum is tens to hundreds of volts higher than in a normal state for a used charger. The following are supposed causes of the increase of the surface potential of the photoreceptor drum entailed when a DC bias is mainly applied to the virgin brush charger.

1. The brush fibers are not uniformly in contact with the photoreceptor drum in an initial stage, in particular.

2. Influences of impurities, such as fats and oils, adhering to the brush fiber surface in the process of manufacturing the brush.

When halftone printing is carried out with the surface potential of the photoreceptor drum increased, noticeable white stripes are produced for about 60 seconds after the start. The production of these stripes can be reduced by superposing an AC bias on a DC bias, as mentioned before. Thus, when a DC bias with a specific AC bias below the convergent charge region superposed thereon is applied to the brush charger, the white stripes peculiar to the brush charger are reduced to a level much lower than when a DC bias is applied, without regard to the stage of operation, initial or not. Presumably, this is because only those regions which are striped due to partial excessive increase of the surface potential are de-electrified in an AC reverse charging process. Naturally, the use of the superposed bias can produce a great effect against a potential increase which arouses a problem in an initial stage of use of a brand-new brush.

The superposed bias has the effect within the ranges of DC 400 to 800 V and AC 150 to 400 V and with the AC frequency of 200 Hz to 2 kHz, preferably DC 500 to 650 V, AC 300 to 400 V, and 1 kHz or less. Application of the superposed bias of this level never causes the aforesaid problems aroused when the DC bias is applied. Details of this system are described in Jpn. Pat. Appln. KOKAI Publication No. 5-66302.

Figure 3A:
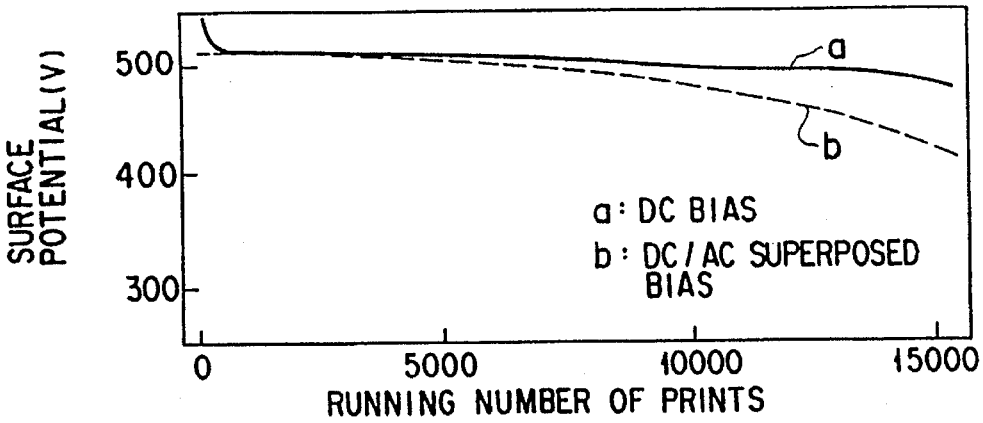
FIG. 3A is a graph showing changes of the surface potential in a running test on the rotating-brush charger.

If the superposed bias, which includes the AC bias, is used, however, the resistance of the brush charger to dirt lowers considerably, as mentioned before. FIG. 3A shows the results of surface potential measurement in a running test on a rotating-brush charger, based on comparison between DC bias and DC/AC superposed bias. The test was conducted applying a normal voltage of 1 kV as the DC bias and using DC 600 V, AC 300 V, and AC frequency of 800 Hz for the DC/AC superposed bias.

Figure 3B:
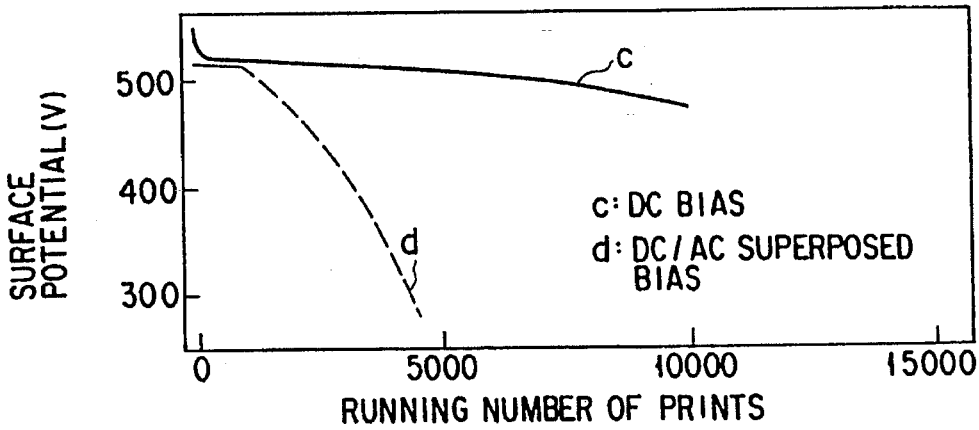
FIGS. 3B and 3C are graphs showing changes of the surface potential in running tests on the stationary-brush charger.

According to this test, the surface potential was found to be substantially stable after preparation of 15,000 prints with use of the DC bias only (curve a). When the DC/AC superposed bias (curve b) was used, however, the surface potential partially lowered due to soiling of the brush, so that some charge failure appeared on the image. The stationary-brush charger proved conspicuous for this tendency. FIG. 3B shows the results of measurement for this case using the same applied bias as that for the rotating-brush charger. This graph indicate that the surface potential made no substantial difference after preparation of 10,000 prints with use of the DC bias (curve c), while the image quality was deteriorated and the surface potential was considerably lowered due to charge failure after preparation of only less than 2,000 prints with use of the DC/AC superposed bias (curve d). Thus, if the DC/AC superposed bias is used, the resistance to dirt, and therefore, life performance, of the brush charger will be lowered.

Figure 4:
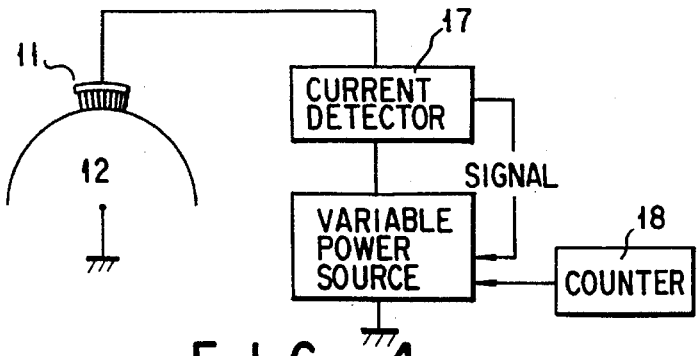
FIG. 4 is a diagram showing a detector circuit with a current detector for detecting the current value of a DC/AC superposed bias applied to the brush charger.

To avoid this, a device 17 for detecting a current value is provided in advance in applying the DC/AC superposed bias to the brush charger 11, as shown in FIG. 4. Since no charge failure occurs in the initial state, there is a relatively large flow of current. When the current flow is stabilized afterward and if the number of prints exceeds a thousand so that charge failure develops gradually, the current value lowers considerably. Thereupon, the lowering current value is detected, and the ratios for the DC and AC components of the DC/AC superposed bias is changed when the current value is reduced below the preset point for the machine.

Figure 3C:
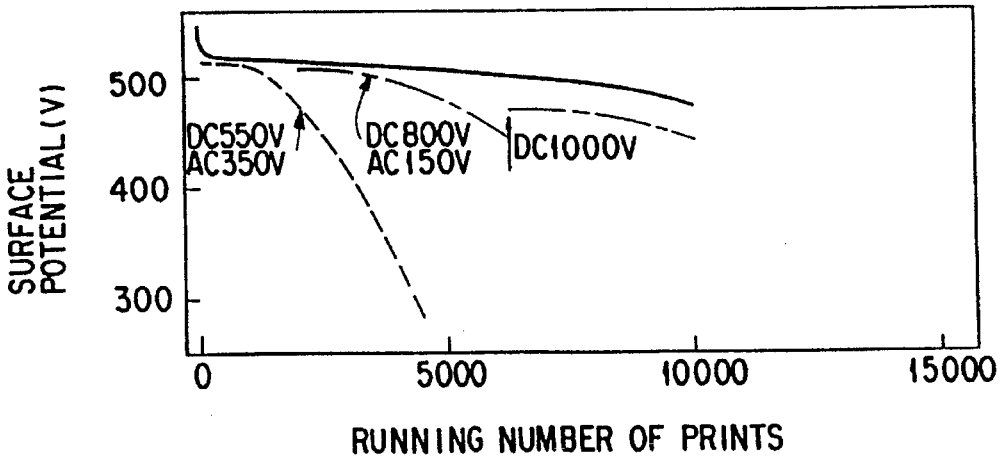

In doing this, the DC component is raised and the AC component is lowered, respectively, whether continuously or in stages, so that charging with the DC component is dominant. Even charge failure is generated due to the AC component, therefore, the image cannot be greatly influenced. In an experiment, the biases were changed in three stages. More specifically, biases of DC 600 V and AC 300 V were used in the initial stage, DC 800 V and AC 150 V in the stage for the start of current reduction, and only DC 1,000 V in the stage for additional reduction. Thereupon, a good result was obtained such that the reduction of the surface potential was less than in the case where the DC/AC superposed bias with a constant ratio was simply used (curve d), as shown in FIG. 3C.

Moreover, a satisfactory effect can be produced by simply changing the biases in accordance with a signal from a counter 18 for counting the number of consumed paper sheets in the process cartridge without providing any special mechanism for detecting the current, as shown in FIG. 4. It is to be understood that stable surface potential and image quality can be enjoyed for a long period of time after the initial stage by using the DC/AC superposed bias (DC 550 V and AC 350 V) for first 2,000 prints and only the DC bias (1 kV) for all the subsequent prints, for example.

According to the first embodiment of the present invention, as described above, the contact charging means is used as the charging means, and means is provided for detecting the state of the contact charging means and adjusting the ratios for the DC and AC components applied to the charging means, in accordance with the detected value. Thus, the surface potential of the charging means can be stabilized so that good image quality can be maintained for a long period after the user's first use of the brand-new charger.

The following is a description of a second embodiment of the present invention.

Figure 5:
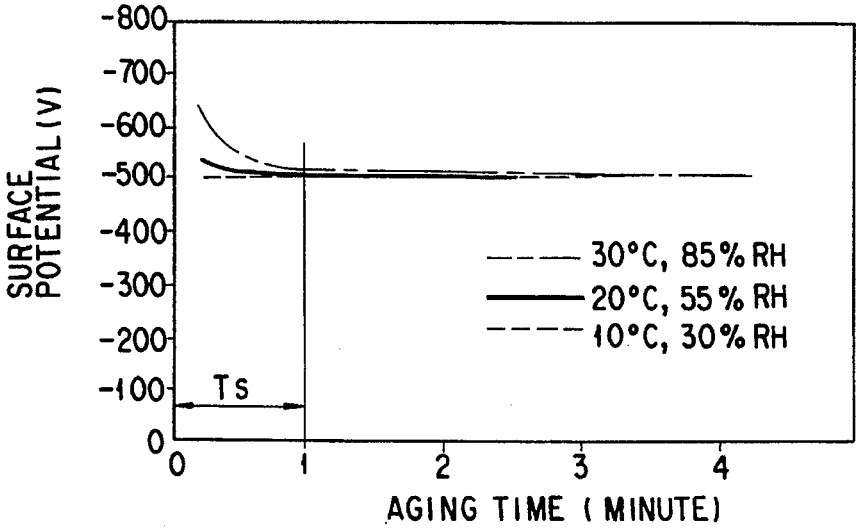
FIG. 5 is a graph showing changes of charging potentials caused when a photoreceptor drum is charged by means of a brand-new brush charger.

As mentioned before, the contact charging lacks in stability in the initial stage of operation. FIG. 5 shows changes of charging potentials caused when the photoreceptor drum is charged by means of a brand-new brush charger. As seen from FIG. 5, the initial surface potential is very high in hot and humid ambient conditions, stabilization requires one minute on the average. If the printing is effected with use of such a high potential, the halftone density is inevitably low. In this high-potential state, there are partial high-potential regions attributable to charge injection, and these high-potential regions cause halftone white stripes.

Once stabilized, however, the surface potential, which is a little higher at the start, cannot be so high as the extraordinarily high potential for the brand-new brush even when the hot and humid ambient conditions are given again.

When the process unit is mounted in the machine, it is determined whether the unit is brand-new or not. If this process unit is concluded to be brand-new, the photoreceptor drum is charged by means of the charging brush as an initializing operation. In this case, the initializing operation is performed for about one minute.

Figure 6:
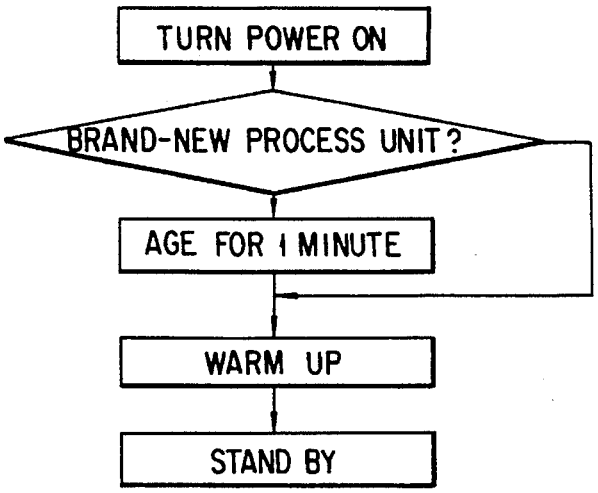

The initializing operation is an operation such that a predetermined bias is applied to the charging means with the photoreceptor drum rotating. In the present embodiment, a normal bias of −200 V is applied to the developing device, and the developing roller rotates. FIG. 6 shows the sequence of the initializing operation with the machine power on.

The following is a description of a method of determining whether the currently mounted process unit is brand-new or not. The process unit comprises a substrate including a memory which is stored with the product number of the unit. When the power is turned on with the process unit mounted in the machine body or when the process unit is mounted with the power on, a controller on the body side reads the product number of the process unit. A memory unit on the body side is stored with the respective product numbers of process units having so far been mounted. Whether the currently mounted process unit is brand-new or not is determined by comparing its product number with the stored numbers. If the unit is concluded to be brand-new, the initializing operation is performed for one minute. If not, normal warm-up operation is started.

Other methods of discriminating the brand-newness of process units include a method in which the whole or part of the photoreceptor drum of each brand-new unit is covered by black paper so that the brand-newness of the unit can be discriminated by reading the presence of the black paper by means of an optical sensor. The black paper is automatically wound up and recovered in the process unit.

Also, there is a method in which the product number is indicated in the form of a bar code in a predetermined position on each process unit so that the brand-newness of the unit can be discriminated by reading the number or code by means of a bar code reader on the body side.

By thus performing the initializing operation for the predetermined period of time, the instability of the initial surface potential of the brand-new brush can be removed. The time Ts required for the stabilization of the potential varies little according to individual stationary charging brushes, in particular, and the initialization time is uniform in many cases. However, rotating charging brushes are subject to great variations in the stabilization time, and their surface potential cannot be easily stabilized by this method.

Figure 7:
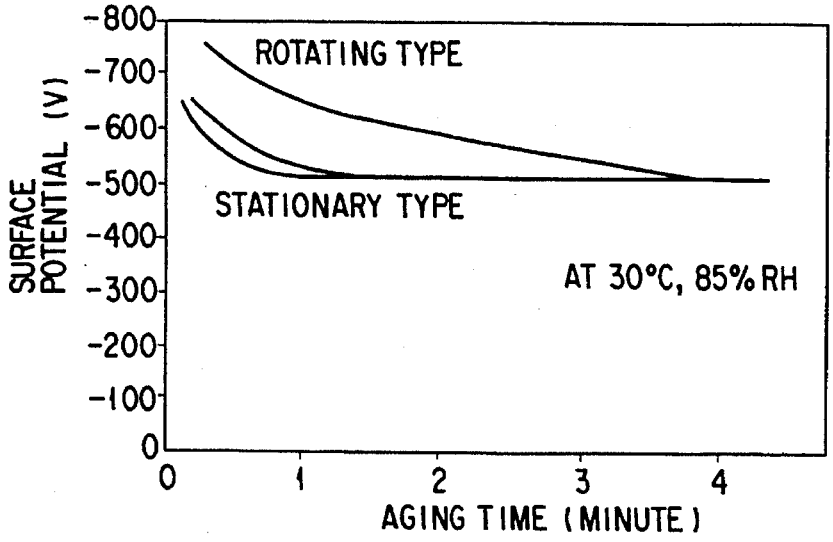
FIG. 7 is a graph showing the relationships between the aging time and the surface potential of the photoreceptor drum established with use of rotating- and stationary-brush chargers.

FIG. 7 shows the results of measurement of initial surface potentials on 20 rotating brushes and 20 stationary brushes. In hot and humid conditions, the stationary brushes are subject to very small differences in potential variation, and the charging potentials of all the brushes are stabilized by one minute of aging. On the other hand, some rotating brushes require only about one minute for the stabilization of the potential, and others require about 3 minutes. If the initialization time is 1.5 minutes, most of brushes can enjoy a substantially satisfactory stabilized potential. However, the potentials of some brushes may be nearly 150 V higher than the stabilized potential. In this case, some of the units, such as the ones shown in FIGS. 2A and 2B, cannot be stabilized by one minute of aging, so that image failure may possibly be caused. However, 3 minutes of aging for the stabilization of all the brushes is a redundant task for the user.

Figure 8:
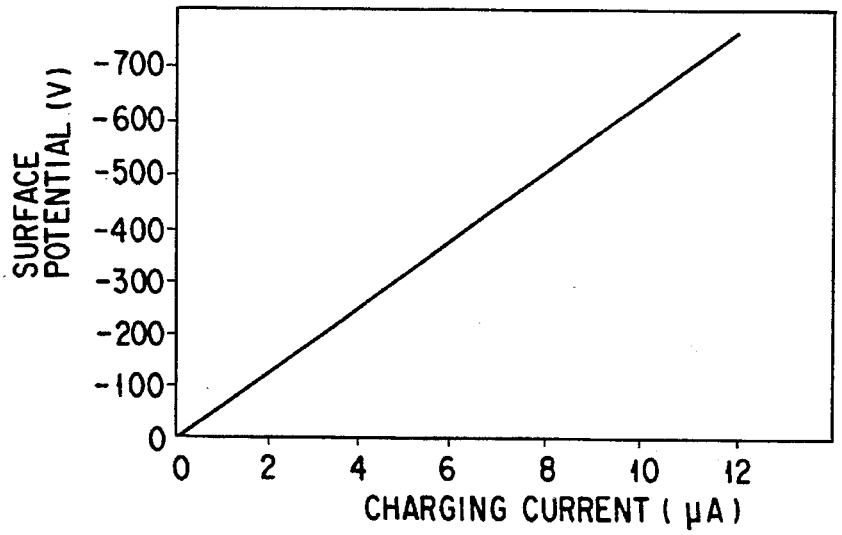
FIG. 8 is a graph showing the relationship between charging current flowing from a power source into the brush charger and the surface potential of the photoreceptor drum.
Figure 9:
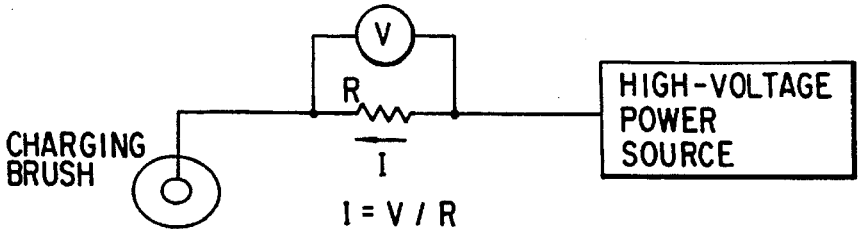
FIG. 9 is a diagram showing a detector circuit with a current detector for detecting the value of the charging current flowing from the power source into the brush charger.

According to a proposed example using the rotating brushes, therefore, the initializing operation is performed in consideration of the differences in properties between the individual brushes. FIG. 8 shows the relationship between the current flowing from the power source into the brush and the surface potential of the photoreceptor drum. The graph of FIG. 8 indicates a substantially proportional relation between the current and the potential. The surface potential of the photoreceptor drum can be detected by sensing the current flowing into the brush by means of a detector circuit, such as the one shown in FIG. 9. Accordingly, the system is designed so that the initializing operation can be finished when the surface potential is reduced below a certain level as it is stabilized during the initializing operation.

Figure 10:
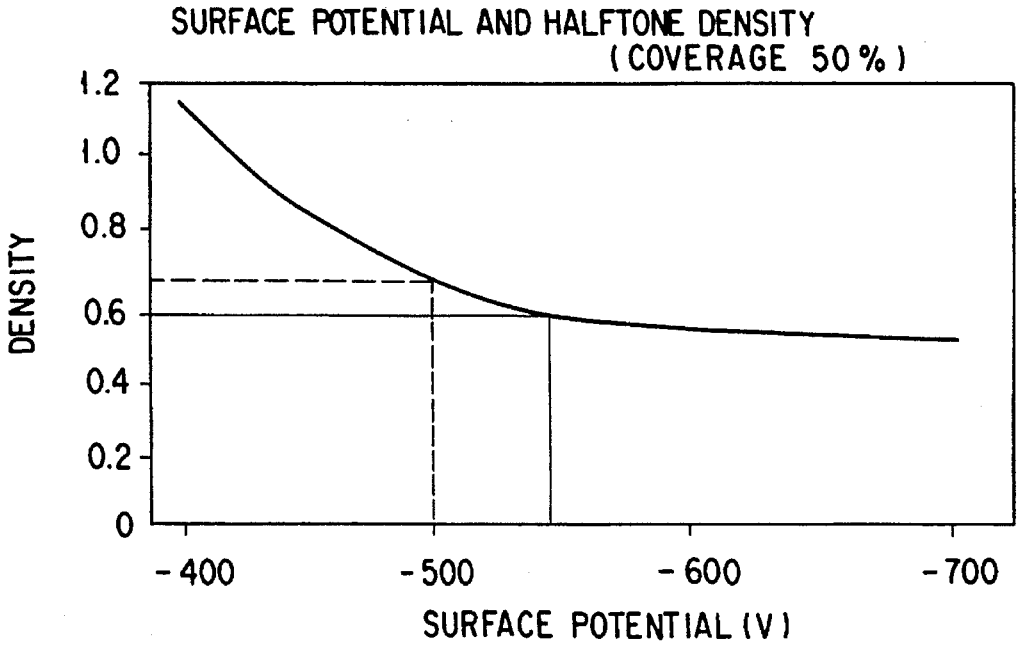
FIG. 10 is a graph showing the relationship between the surface potential of the photoreceptor drum and the halftone density corresponding to a printing rate of 50%.

FIG. 10 shows the relationship between the surface potential of the photoreceptor drum obtained with use of the developing bias of −200 V and the halftone density corresponding to a printing region of 50%. If the absolute value of the photoreceptor potential is smaller than that of −550 V, the variation of the halftone density compared with that corresponding to a standard surface potential of −500 V is not greater than 0.1, so that there is no problem on the image quality.

Figure 11:
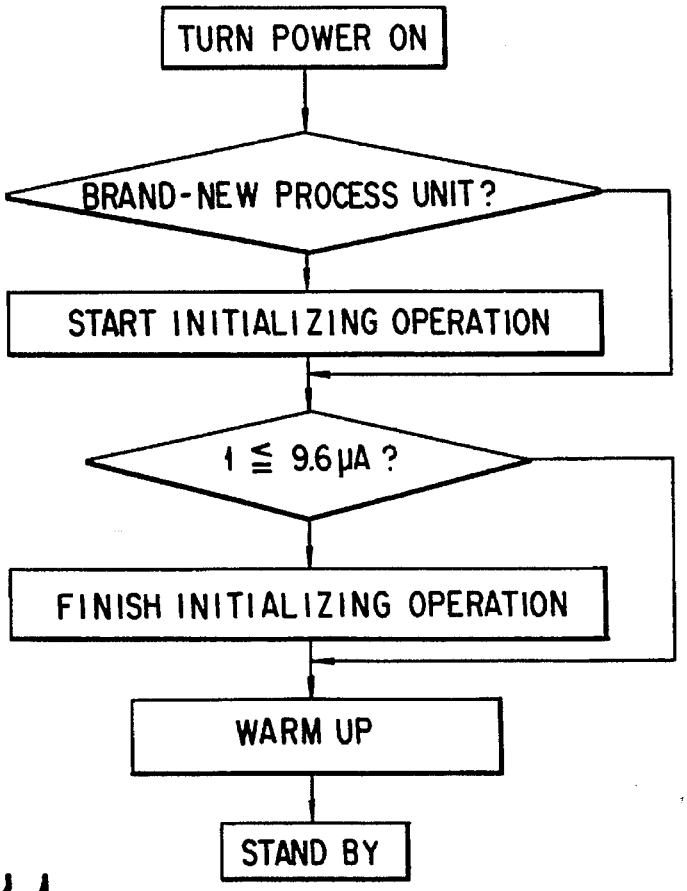
FIG. 11 is a flow chart showing the sequence of the initializing operation for the case in which a rotating-brush charger is used.

As shown in FIG. 8, current values I for the surface potentials of −500 V and −550 V are −8 μm and 8.8 μA, respectively. Thus, when the current value is lowered to 8.8 μA or less, the initializing operation is finished. FIG. 11 is a flow chart showing the initializing operation for the case in which a rotating charging brush is used.

Figure 16:
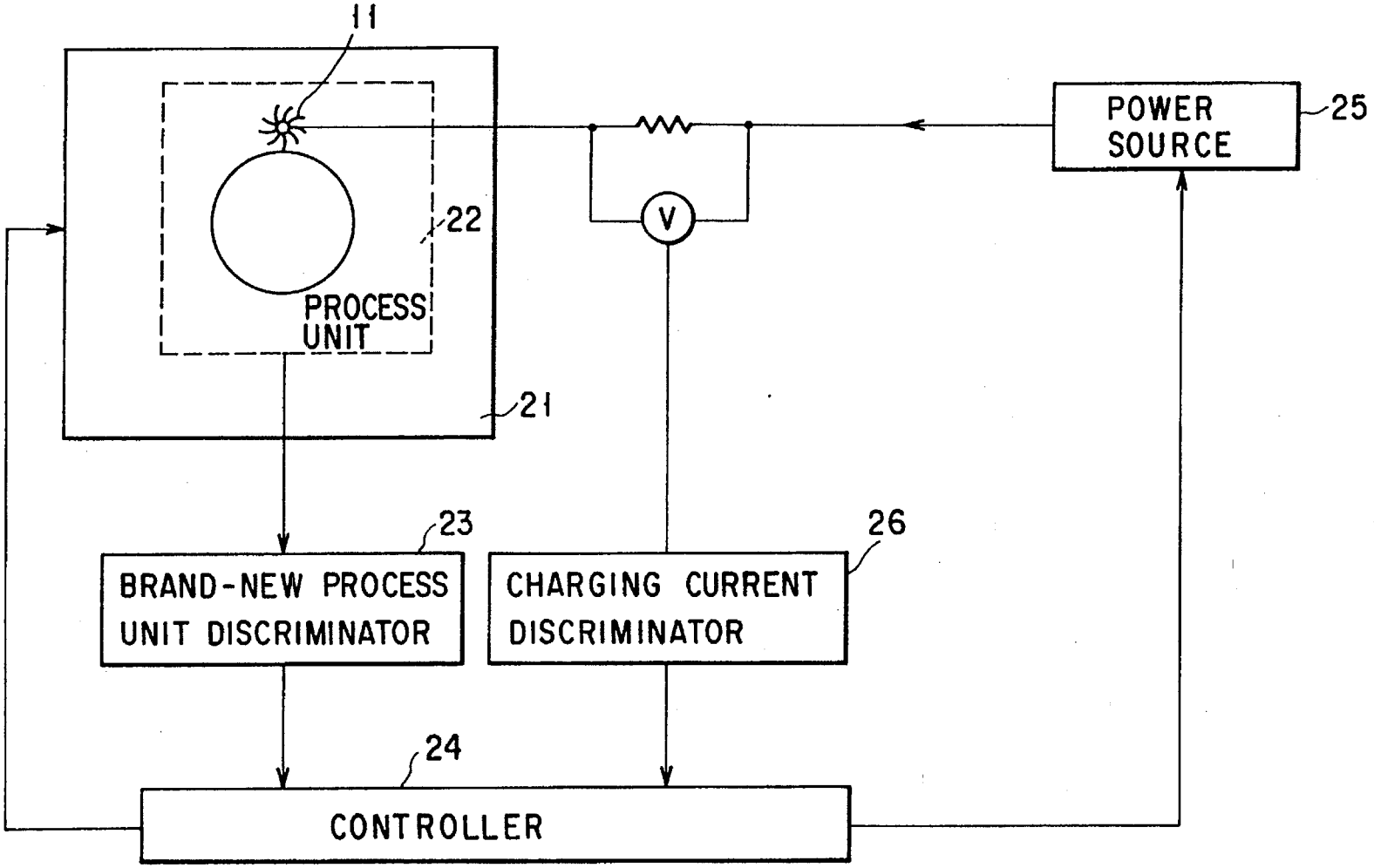
FIG. 16 is a block diagram showing an apparatus having a control mechanism for effecting initializing operation of a printer.

FIG. 16 is a block diagram showing an apparatus having a control mechanism for effecting initializing operation of a printer which has a rotating brush charger. The initializing operation will be explained, with reference to FIGS. 11 and 16.

First, the brand-new process unit discriminator 23 determines whether the process unit 22 mounted on the printer 21 is a new one or not. If the discriminator 23 determines that the unit 22 is not a new one, the controller 24 makes the printer 21 perform an warm-up operation. If the discriminator 23 determined that the unit 22 is a new one, the controller 24 supplies a charging current from the power source 25 to the brush charger 11, thereby aging the brush charger 11. Then, the initializing operation of the printer 21 is performed.

The charging current is monitored. When the charging current discriminator 26 determines that the charging current decreases to a predetermined value, e.g., 8.8 μA or less, the controller 24 stops supplying the brush current from the power source 25 to the brush charger 11. The initializing operation of the printer 21 is thereby terminated. Upon termination of the initializing operation, the controller 24 causes the printer 21 to start a warm-up operation.

Figure 12:
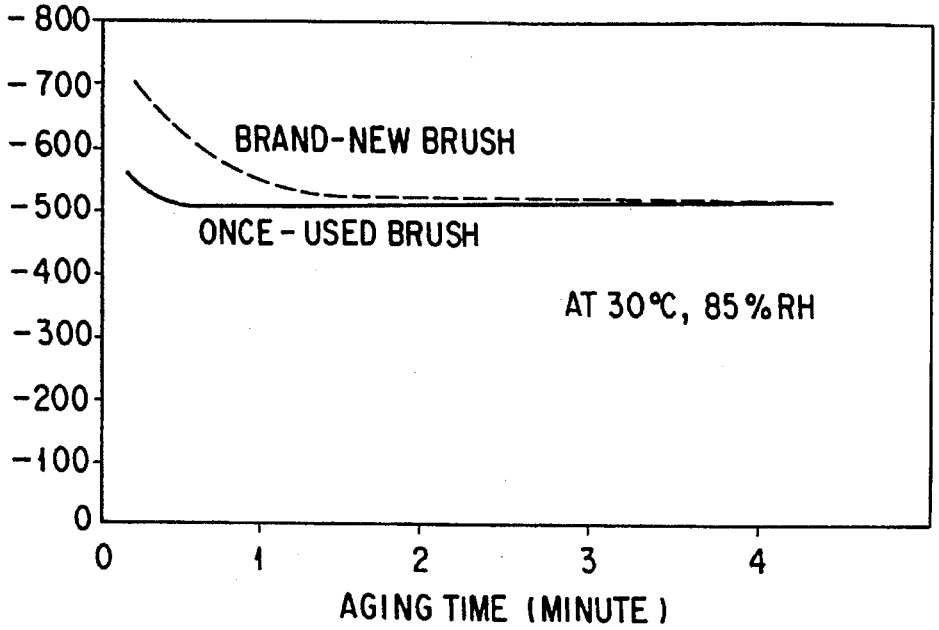
FIG. 12 is a graph showing the relationships between the aging time and the surface potential of the photoreceptor drum established with use of a once-used brush charger.

Once a brush is used, its surface potential is not substantially increased even though it is left again in the hot and humid ambient conditions, as shown in FIG. 12. Since there is a slight increase, however, the aging operation should preferably be performed every time the power is turned on in the case where the brush charging is applied to an apparatus, such as a color printer, which requires production of high-quality images.

By performing this aging operation so that the current for the charging brush is reduced to the predetermined value or below, satisfactory printing can be carried out without requiring unreasonable initializing operation and without being influenced by changes of image density attributable to variations of the initial surface potential.

High-brilliance printing was tried using a small-particle toner.

Figure 13:
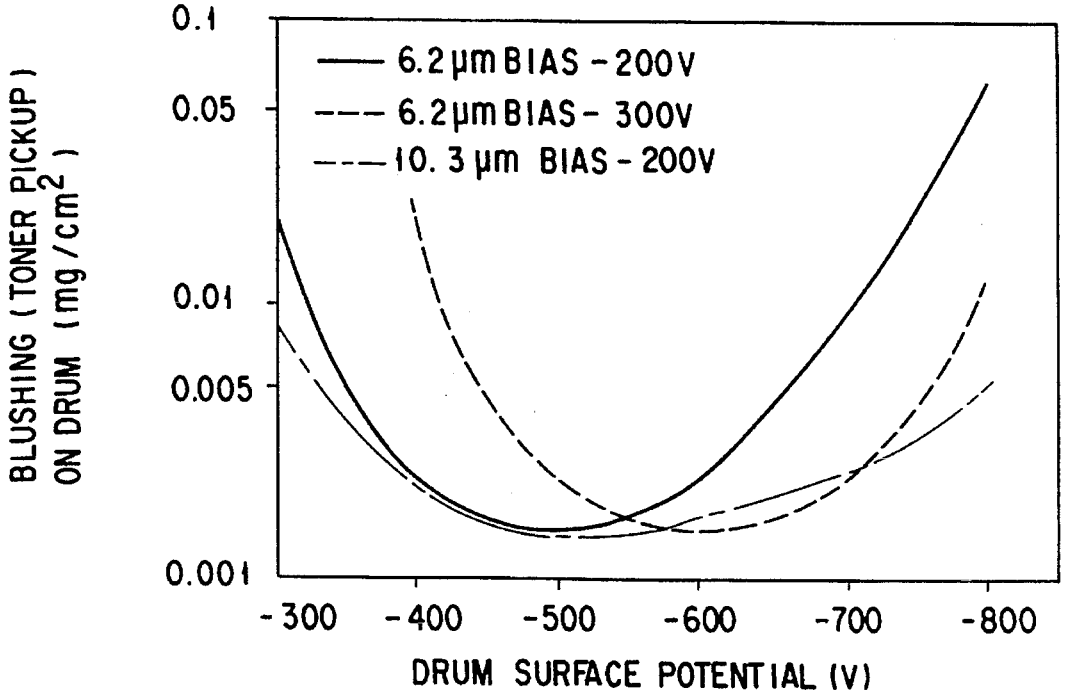
FIG. 13 is a graph showing the relationships between the surface potential of the photoreceptor drum and toner pickup in a no-image region established with use of a developing bias of −200 V.

It is generally known that the resolution, halftone denseness, etc. can be improved if printing is effected with use of a toner with a particle diameter of 6.2 μm (volume average particle diameter) or less. However, the reduced toner particle diameter has some adverse effects. FIG. 13 shows the relationships between the surface potential of the photoreceptor drum and toner pickup (i.e., fogging toner amount) in a no-image region established when the developing bias is at −200 V. In the no-image region, fog is restrained by an electric field which is generated by the difference between the developing bias and the surface potential of the photoreceptor drum. However, fog easily occurs if this potential difference is too great. This tendency is marked when the aforesaid one-component contact type developing is carried out using the small-particle toner.

If the toner pickup in the no-image region exceeds 0.01 mg/cm$^2$, problems are aroused including an increase in toner consumption, burrs on the cleaning blade, etc.

If a brand-new charging brush is used, the surface potential is increased during the initializing operation, as mentioned before. In some cases, the surface potential higher than −700 V, so that the toner pickup in the no-image region inevitably exceeds 0.01 mg/cm$^2$.

If the developing bias then ranges from −200 V to −300 V, the toner pickup in the no-image region can be restricted to 0.01 mg/cm$^2$ or less, as shown in FIG. 13. In performing the normal printing operation after the initializing operation, the surface potential is substantially as high as a preset potential of −500 V, so that the developing bias should only be adjusted to −200 V. By controlling the developing bias in this manner, excessive toner consumption, burrs on the cleaning blade, etc. can be prevented during the initializing operation for the new brush.

Although the adhesion of the toner to the no-image region is prevented by controlling the developing bias in the arrangement described above, it may be also prevented by suspending the rotation of the developing device during the initializing operation.

The method for controlling the developing bias by detecting the charging current can be also effectively applied to a normal printing mode. If the toner or the like adheres to the brush, the surface potential of the brush is liable to increase in humid ambient conditions. Thereupon, a surplus of the toner adheres to the no-image region, thereby entailing an increased toner consumption and lowered halftone density. Accordingly, a trial was made to control the developing bias in accordance with a detected value of a charging current I.

Table 1 shows variations of the toner pickup in the no-image region and halftone density (coverage: 50%) for cases in which the developing bias is kept at −200 V without any change and is changed from −200 V to −300 V in accordance with the charging current I with the surface potential varying from −500 V to −700 V.

TABLE 1

| | Developing bias 200V | | Developing Bias Control | |
|---|---|---|---|---|
| Surface Potential | Halftone density | Toner pickup in no-image region (mg/cm2) | Halftone density | Toner pickup in no-image region (mg/cm$^2$) |
| −500V | 0.72 | 0.02 | 0.72 | 0.02 |
| −600V | 0.58 | 0.035 | 0.70 | 0.02 |
| −700V | 0.51 | 0.012 | 0.69 | 0.03 |

As seen from Table 1, the blushing on the drum and the halftone density variation can be restricted to 0.01 mg/cm$^2$ or less and 0.1 or less at all times by controlling the developing bias.

According to the second embodiment of the present invention, as described above, the aging operation is performed for a predetermined period of time in connecting the apparatus to the power supply or replacing the charger, and the operation mode is changed from the aging operation to the image forming operation when a predetermined value is reached by the charging current from the charger. Accordingly, the variation of the halftone density and the increase of the toner consumption, which are attributable to the unstable initial potential for the contact charging, especially the charging by means of the brush, can be prevented. Moreover, satisfactory image formation can be effected, and unduly prolonged aging operation can be prevented.

In the image forming apparatus according to the present invention, as described herein, the charging current applied to the contact charger is detected in consideration of the characteristic of the surface potential of the image carrying body to vary depending on the charging current. The surface potential of the photoreceptor drum is stabilized by performing a predetermined operation on the basis of the detected value. Thus, an improved image quality can be enjoyed for a long period of time from the initial stage.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus, comprising:

contact charging means for charging the surface of an image carrying body;

image forming means for forming an image on the charged image carrying body;

means for applying a DC/AC superposed bias to the contact charging means;

detecting means for detecting a current value of the superposed bias applied to the contact charging means; and means for controlling the AC:DC ratio of the superposed bias applied to the contact charging means, in accordance with a detected value from the detecting means, wherein said superposed bias is a bias obtained by superposing an AC bias of 150 to 400 V on a DC bias of 500 to 800 V.

2. An image forming apparatus according to claim 1, wherein said superposed bias is a bias obtained by superposing an AC bias of 300 to 400 V on a DC bias of 500 to 650 V.

3. An image forming apparatus according to claim 1, wherein said controlling means comprises means for lowering the voltage ratio for the AC and DC components of the superposed bias in accordance with a reduction of the current value of the superposed bias, detected by the detecting means.

4. An image forming apparatus according to claim 1, wherein said controlling means comprises means for lowering the voltage ratio for the AC and DC components of the superposed bias in stages in accordance with a reduction of the current value of the superposed bias, detected by the detecting means.

5. An image forming apparatus according to claim 1, wherein said controlling means comprises means for continuously lowering the voltage ratio for the AC and DC components of the superposed bias in accordance with a reduction of the current value of the superposed bias, detected by the detecting means.

6. An image forming apparatus according to claim 1, wherein said contact charging means comprises a brush charger.

7. An image forming apparatus according to claim 1, wherein said contact charging means comprises a rotating-brush charger.

8. An image forming apparatus according to claim 1, wherein said contact charging means comprises a stationary-brush charger.

9. An image forming apparatus, comprising:

contact charging means for charging the surface of an image carrying body;

image forming means for forming an image on the charged image carrying body;

means for applying a DC/AC superposed bias to the contact charging means; and means for controlling the AC:DC ratio of the superposed bias applied to the contact charging means, in accordance with a surface potential of the image carrying body, wherein said superposed bias is a bias obtained by superposing an AC bias of 150 to 400 V on a DC bias of 500 to 800 V.

10. An image forming apparatus according to claim 9, wherein said controlling means comprises means for changing voltage ratios for the DC and AC components of the superposed bias in accordance with the frequency of image formation.

11. An image forming apparatus according to claim 9, wherein said superposed bias is a bias obtained by superposing an AC bias of 300 to 400 V on a DC bias of 500 to 650 V.

* * * * *